US006631869B1

(12) United States Patent
Kang

(10) Patent No.: US 6,631,869 B1
(45) Date of Patent: Oct. 14, 2003

(54) TISSUE HOLDER

(76) Inventor: Mei-Lang Kang, 109, Alley 125, Lane 380, Chang Shi Road, Sec. 3, Tainan City (TW)

( * ) Notice: Subject to any disclaimer, the term of this patent is extended or adjusted under 35 U.S.C. 154(b) by 0 days.

(21) Appl. No.: 10/212,336

(22) Filed: Aug. 5, 2002

(51) Int. Cl.[7] ..... B65H 18/04
(52) U.S. Cl. ..... 242/598.5; D6/523
(58) Field of Search ..... 242/598, 598.3, 242/598.5, 598.6, 591, 398, 400, 402, 404, 406, 579, 587, 587.2; D6/512, 522, 523

(56) References Cited

U.S. PATENT DOCUMENTS 3,837,595 A * 9/1974 Boone ..... 242/598.5
4,191,317 A * 3/1980 Harkins ..... 242/598.5
4,844,368 A * 7/1989 Hu ..... 242/598.5
5,495,884 A * 3/1996 Shikler
5,690,302 A * 11/1997 Batts ..... 242/598.3

* cited by examiner

*Primary Examiner*—William A. Rivera
(74) *Attorney, Agent, or Firm*—Alan D. Kamrath; Rider Bennett, LLP

(57) ABSTRACT

A tissue holder comprises a U-shaped frame two slanted grooves at forward portions of two side frame elements and two rigid bells on a central frame element; a roller for rotatably supporting a roll of tissue and being removably retained in the grooves; a flap assembly pivotably disposed on the frame and including a forward bent section, a rearward slanted section, and a tissue tearing opening bordered the slanted section; two resilient suction cups each having a central thread shank through a central hole of the bell for engagement; and fastening means secured onto projected portions of the shanks for forming a vacuum in an interior of each bell for immovably and captively retaining the holder on a wall. In a clockwise or counterclockwise rotation of the roll of tissue, a path of a piece of tissue is from the slanted section via the opening to the bent section.

1 Claim, 4 Drawing Sheets

TISSUE HOLDER

FIELD OF THE INVENTION

The present invention relates to a tissue holding device and more particularly to a roller type tissue holder with improved characteristics.

BACKGROUND OF THE INVENTION

Prior art tissue holders take various forms. However, such prior tissue holders are typically trouble-prone and unreliable in use. To the worse, a saw-like blade of a certain tissue holder may hurt a user's hand if sufficient care is not taken in tearing a piece of tissue. Thus improvement exists.

SUMMARY OF THE INVENTION

It is therefore an object of the present invention to provide a tissue holding device comprising a U-shaped frame including two side frame elements, two slanted grooves at forward portions of the side frame elements, a central frame element, two bells formed of relatively hard material, being spaced apart on an upper portion of the central frame element, each bell having a central hole; a roller for rotatably supporting a roll of tissue and being removably retained in the grooves; a substantially rectangular flap assembly pivotably disposed on the frame and including a forward downward elongate bent section, an elongate slanted section extended rearward downward from the bent section and having a lower edge pressed on the roll of tissue, and a tissue tearing opening bordered the slanted section; two suction cups formed of resilient material, each suction cup having a central thread shank through the central hole of the bell for engagement; and fastening means secured onto projected portions of the shanks for forming a vacuum in an interior of each bell so as to immovably and captively retain the device on a wall; wherein in a clockwise or counterclockwise rotation of the roll of tissue, a path of the roll of tissue is from an outer surface of the slanted section via the tissue tearing opening to an outer surface of the bent section.

The above and other objects, features and advantages of the present invention will become apparent from the following detailed description taken with the accompanying drawings.

DETAILED DESCRIPTION OF THE PREFERRED EMBODIMENTS

Figure 1:
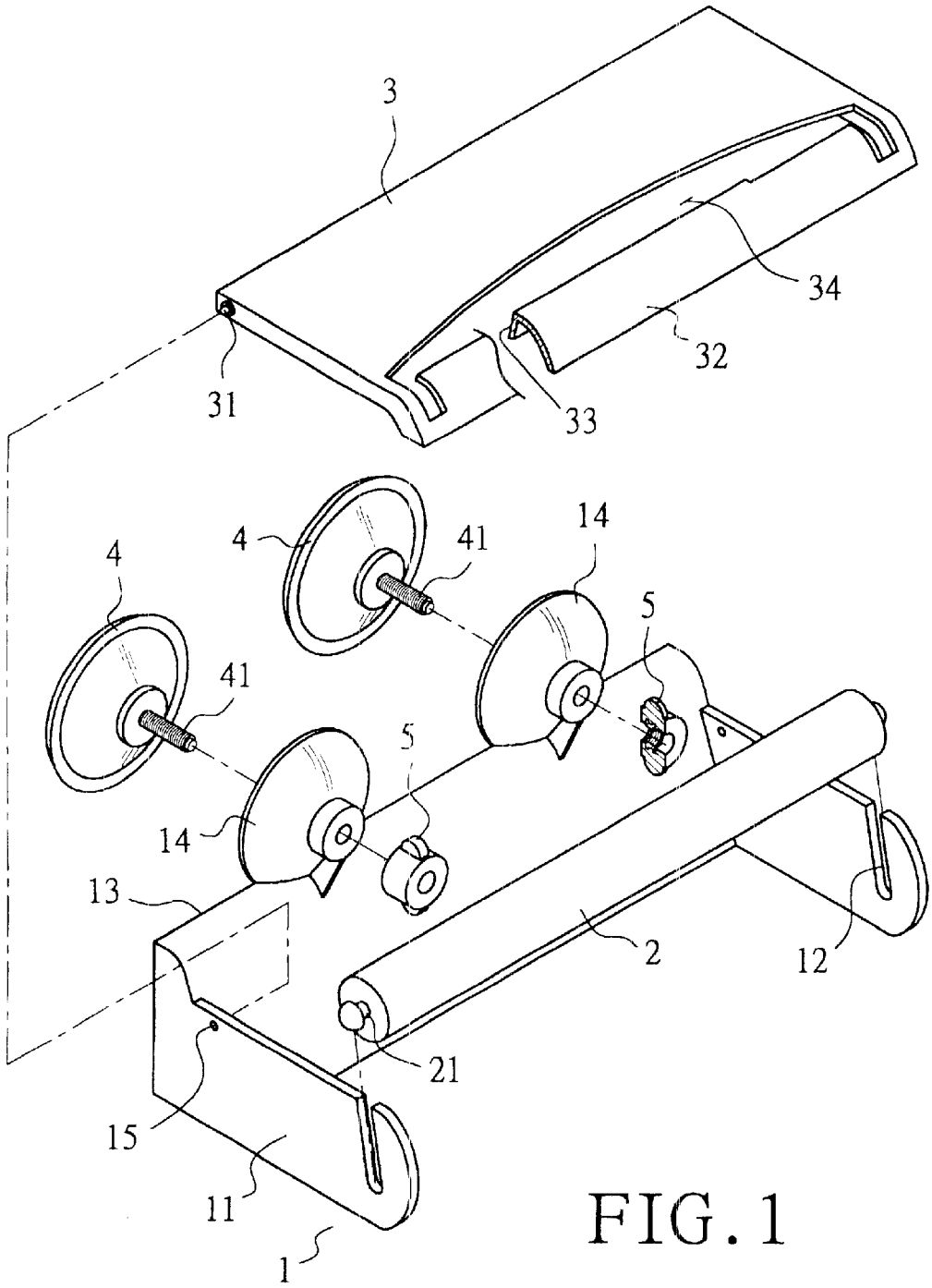
FIG. 1 is an exploded view of a preferred embodiment of a tissue holder according to the invention.
Figure 2:
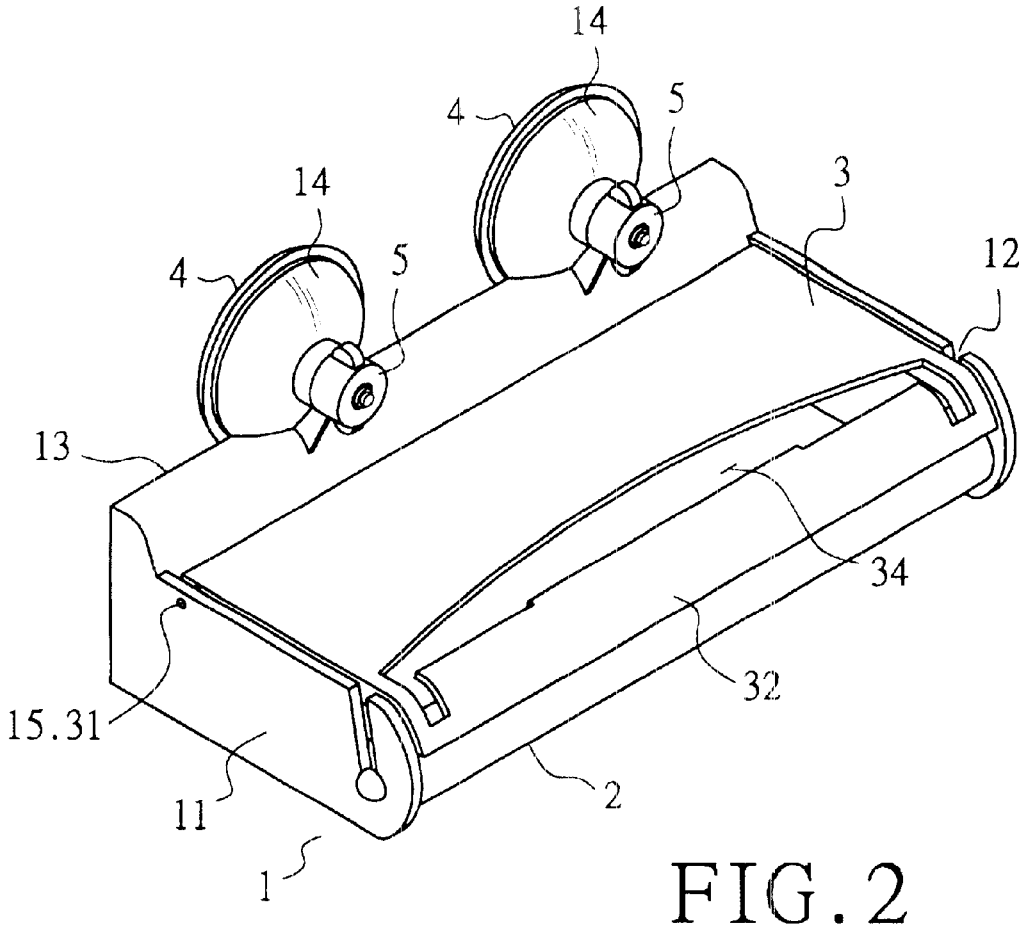
FIG. 2 is a perspective view of the assembled holder.

Referring to FIGS. 1 and 2, there is shown a tissue holder constructed in accordance with the invention comprising a U-shaped frame 1 including two side frame elements 11, two slanted grooves 12 at forward portions of the side frame elements 11, a central frame element 13, two bells 14 formed of relatively hard material, being spaced apart on an upper portion of the central frame element 13 and having a sufficient strength to resist elevated stress, and two holes 15 at rearward portions of the side frame elements 11; a roller 2 including two enlargements 21 at both ends; a substantially rectangular flap assembly 3 including two side pins 31, a forward downward elongate bent section 32, an elongate slanted section 33 extended rearward downward from the bent section 32, and a tissue tearing opening 34 bordered the slanted section 33; two suction cups 4 formed of a resilient material, each suction cup 4 having a central thread shank 41; and two fasteners (e.g., wing nuts) 5.

Figure 3:
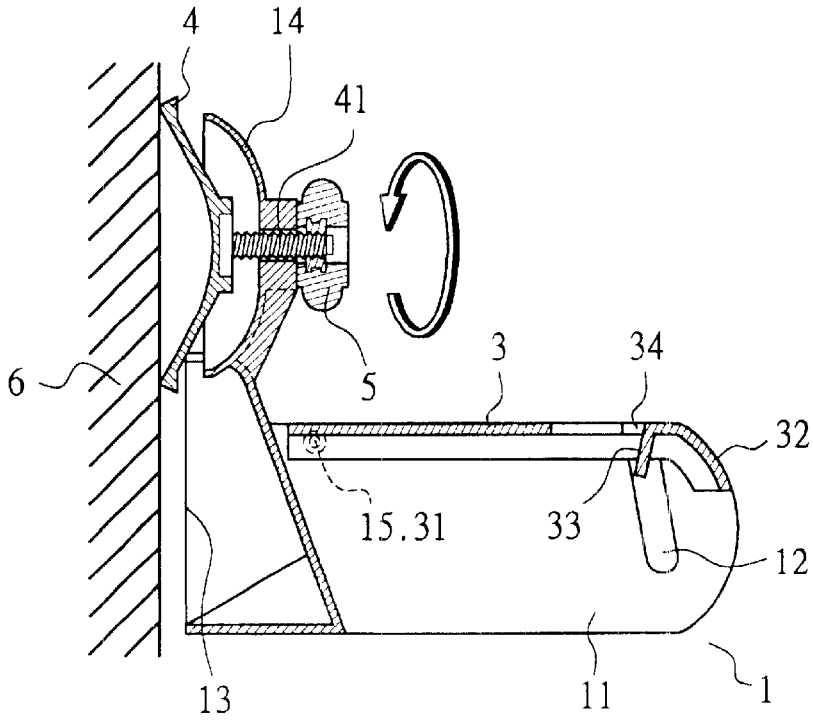
FIG. 3 is an axial section of the FIG. 2 holder showing a mounting of a suction cup thereof onto a wall.
Figure 4:
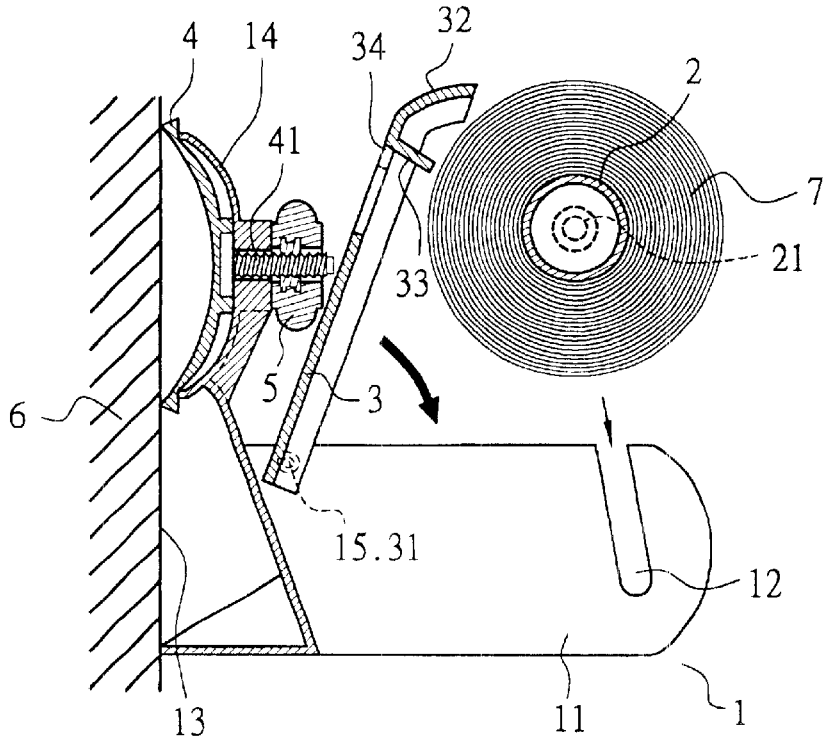
FIG. 4 is a view similar to FIG. 3 showing a mounting a roll of tissue into the holder.

Referring to FIGS. 3 and 4, an assembly of the tissue holder will now be described below. First, insert the pins 31 into the holes 15. It is designed that a diameter of the pin 31 is suitably smaller than that of the hole 15 so that the pins 31 are pivotable about the holes 15 and thus, the flap assembly 3 can be pulled up a predetermined angle about the frame 1. Next, mount a roll of tissue 7 around the roller 2. Then insert indented portions of the enlargements 21 in the grooves 12 in response to a lift of the flap assembly 3. It is designed that a diameter of the indented portion of the enlargement 21 is suitably smaller than a width of the groove 12 so that the enlargements 21 are pivotable about the grooves 12 and thus, the roller 2 can rotate about the frame 1. Next, drive the shanks 41 through central holes of the bells 14 for engagement. Then drive the fasteners 5 onto projected portions of the shanks 41. Advantageously, outer edges of the bells 14 bear upon edges of the suction cups 4 if the fasteners 5 are tightened, thus retaining the edges of the suction cups 4, while the middle parts of the suction cups 4 are drawn into the interiors of the bells 14. In this way the tissue holder is immovably and captively retained on a wall 6 by a vacuum thus produced. This is the case with known suction cups in other fields.

Figure 5:
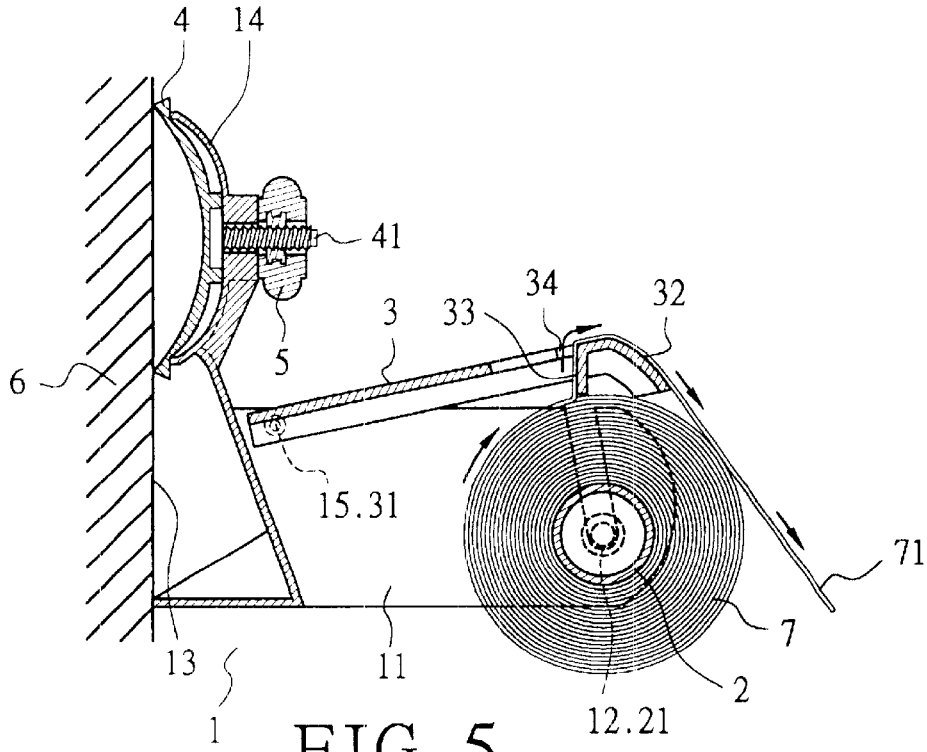
FIG. 5 is an axial section of the FIG. 2 holder in which the roll of tissue is rolled out clockwise.
Figure 6:
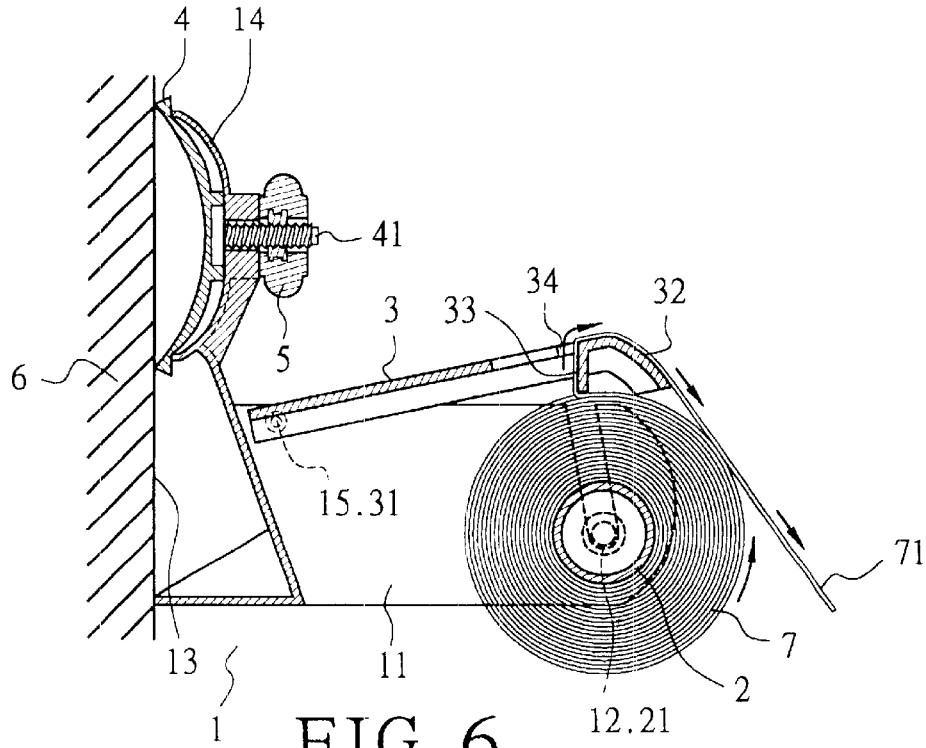
FIG. 6 is a view similar to FIG. 5 in which the roll of tissue is rolled out counterclockwise.

Referring to FIGS. 5 and 6, an operation of the tissue holder will now be described below. In a clockwise or counterclockwise rotation of the roll of tissue 7, a path of the roll of tissue 7 is through an outer surface of the slanted section 33 which is slightly pressed on an outer surface of the roll of tissue 7, the tissue tearing opening 34, and an outer surface of the bent section 32. Thus, a user can easily tear a piece of tissue 71 of a desired length off the tissue holder by tearing the roll of tissue 7 at the tissue tearing opening 34.

While the invention has been described by means of specific embodiments, numerous modifications and variations could be made thereto by those skilled in the art without departing from the scope and spirit of the invention set forth in the claims.

What is claimed is:

1. A tissue holding device comprising:

a U-shaped frame including two side frame elements, two slanted grooves at forward portions of the side frame elements, a central frame element, two bells formed of relatively hard material, being spaced apart on an upper portion of the central frame element, each bell having a central hole;

a roller for rotatably supporting a roll of tissue and being removably retained in the grooves;

a substantially rectangular flap assembly pivotably disposed on the frame and including a forward downward elongate bent section, an elongate slanted section extended rearward downward from the bent section and having a lower edge pressed on the roll of tissue, and a tissue tearing opening bordered the slanted section;

two suction cups formed of resilient material, each suction cup having a central thread shank through the central hole of the bell for engagement; and fastening means secured onto projected portions of the shanks for forming a vacuum in an interior of each bell so as to immovably and captively retain the device on a wall;

wherein in a clockwise or counterclockwise rotation of the roll of tissue, a path of the roll of tissue is from an outer surface of the slanted section via the tissue tearing opening to an outer surface of the bent section.

* * * * *